US010794131B2

(12) United States Patent
Fedders et al.

(10) Patent No.: US 10,794,131 B2
(45) Date of Patent: Oct. 6, 2020

(54) SYSTEM, APPARATUS AND METHOD FOR ADJUSTING A WEIR

(71) Applicant: M-I L.L.C., Houston, TX (US)

(72) Inventors: John H. Fedders, Florence, KY (US); Benjamin Lanning Holton, Covington, KY (US)

(73) Assignee: M-I L.L.C., Houston, TX (US)

( * ) Notice: Subject to any disclaimer, the term of this patent is extended or adjusted under 35 U.S.C. 154(b) by 0 days.

(21) Appl. No.: 15/758,343

(22) PCT Filed: Oct. 10, 2016

(86) PCT No.: PCT/US2016/056206
§ 371 (c)(1),
(2) Date: Mar. 8, 2018

(87) PCT Pub. No.: WO2017/062928
PCT Pub. Date: Apr. 13, 2017

(65) Prior Publication Data

US 2018/0266199 A1 Sep. 20, 2018

Related U.S. Application Data

(60) Provisional application No. 62/239,768, filed on Oct. 9, 2015.

(51) Int. Cl.
*E21B 21/08* (2006.01)

(52) U.S. Cl.
CPC ..... *E21B 21/08* (2013.01)

(58) Field of Classification Search
CPC combination set(s) only.
See application file for complete search history.

(56) References Cited

U.S. PATENT DOCUMENTS 1,978,356 A * 10/1934 Wilkins ..... C25D 17/02 204/212
2,857,055 A * 10/1958 Glasgow ..... G05D 9/02 96/168

(Continued)

FOREIGN PATENT DOCUMENTS

CN 2017337721 * 2/2011 ..... C02F 1/00
EP 825895 B1 12/1998
WO 2001/81014 A2 11/2001

OTHER PUBLICATIONS

International Preliminary Report on Patentability for the equivalent International patent application PCT/US2016/056206 dated Apr. 19, 2018.

(Continued)

*Primary Examiner* — Taras P Bemko
*Assistant Examiner* — Ronald R Runyan
(74) *Attorney, Agent, or Firm* — Jeffrey D. Frantz

(57) ABSTRACT

A system, an apparatus and a method for adjusting a weir control the rate and/or speed at which drilling fluid feeds a separator. Multiple separators are typically used in parallel to process fluid returning from the well. A distribution manifold directs fluid to each separator. The weir is positioned within a feeder on an inlet end of the separator and connects to an attachment plate within the feeder. The distribution manifold or other flow control mechanism operates in combination with the weir. Adjustment apparatuses control the height of the weir to determine the rate the fluid flows onto the separator. The adjustment apparatuses provide mechanical and/or automated operation of the weir. Various profiles of the weir and adjustments of the height of the weir within the feeder increase and/or decrease the speed of the fluid as the fluid spills into the separator.

10 Claims, 11 Drawing Sheets

(56) References Cited

U.S. PATENT DOCUMENTS

| | | | | |
|---|---|---|---|---|
| 3,515,836 | A * | 6/1970 | Kallas | H05B 6/02 219/658 |
| 3,988,243 | A * | 10/1976 | Huff | B01D 35/20 210/297 |
| 5,415,776 | A * | 5/1995 | Homan | B01D 17/00 210/519 |
| 6,244,362 | B1 * | 6/2001 | Williams | B01D 33/04 175/206 |
| 6,530,482 | B1 * | 3/2003 | Wiseman | B01D 33/0346 209/253 |
| 7,571,817 | B2 | 8/2009 | Scott et al. | |
| 2002/0079251 | A1 | 6/2002 | Schulte et al. | |
| 2004/0129612 | A1 | 7/2004 | Decenso | |
| 2005/0242002 | A1 | 11/2005 | Stone et al. | |
| 2005/0242009 | A1 | 11/2005 | Padalino et al. | |
| 2006/0243643 | A1 | 11/2006 | Scott et al. | |
| 2010/0270216 | A1 | 10/2010 | Burnett et al. | |
| 2012/0118798 | A1 | 5/2012 | Scott et al. | |
| 2012/0267287 | A1 * | 10/2012 | Bailey | B07B 1/4609 209/10 |
| 2013/0139914 | A1 | 6/2013 | Dahl | |
| 2014/0166592 | A1 | 6/2014 | Holton | |
| 2015/0128832 | A1 * | 5/2015 | Taylor | A47F 3/14 108/50.11 |
| 2015/0377020 | A1 | 12/2015 | Kronenberger et al. | |

OTHER PUBLICATIONS

International Search Report and Written Opinion for the cross referenced International patent application PCT/US2015/038170 dated Sep. 18, 2015.

International Preliminary Report on Patentability for the cross referenced International patent application PCT/U2015/038170 dated Jan. 5, 2017.

International Search Report and Written Opinion for the equivalent International patent application PCT/US2016/056206 dated Jan. 25, 2017.

Office Action for the equivalent Canadian patent application 3001060 dated Dec. 28, 2018.

Office Action for the equivalent Canadian patent application 3001060 dated Nov. 4, 2019.

* cited by examiner

SYSTEM, APPARATUS AND METHOD FOR ADJUSTING A WEIR

CROSS-REFERENCE TO RELATED APPLICATION

This application claims priority to and the benefit of a U.S. Provisional Application having Ser. No. 62/239,768, filed 9 Oct. 2015, which is incorporated by reference herein.

BACKGROUND

In certain industries and/or applications, separating one material from a second material is often desired and/or required. For example, the mining industry has applications in which solids may be separated from fluids to extract a desired ore and/or metal during mining processes. Further, on-shore and/or off-shore drilling applications use various methods and/or equipment to separate solids from fluids in drilling processes.

Generally, various types of separators are used to separate liquids and solids in industrial and/or oilfield applications. For example, oilfield drilling operations use separators with screens to remove solids from a slurry. One type of apparatus used to remove solids from drilling mud is commonly referred to in the industry as a "shale shaker." A shale shaker, also known as a shaker or vibratory separator, is a vibrating sieve-like device upon which returning used oilfield drilling fluid, often called "mud," is deposited and through which substantially cleaner drilling mud emerges.

Oilfield drilling fluid serves multiple purposes in the industry. Drilling mud acts as a lubricant to cool rotary drill bits and facilitate faster cutting rates. Furthermore, the drilling mud counterbalances pressure encountered in subterranean formations. Because the mud evaluation and/or mixture process may be time consuming and expensive, drillers prefer to reclaim and/or reuse the returned drilling mud. The recirculation of the drilling mud requires the fast and efficient removal of the drilling cuttings and other entrained solids from the drilling mud prior to reuse.

The separating screens are vibrated while the mixture of particles and/or fluids is deposited on an input end of the separator. The vibration improves separation and conveys the remaining particles to a discharge end of the separating screen. Additionally, particles that do not pass through the mesh are collected in a bin and/or a pit. The particles and/or fluid that pass through the mesh are collected in a pan and/or a sump below the separating screen.

A continuing desire exists for separators having increased fluid capacity, increased fluid flow-through rates across the screens, and/or improved fluid removal efficiencies. A further desire exists for separators that control the rate of fluid flow and/or the amount of fluid flowing into the separator.

BRIEF DESCRIPTION OF THE DRAWINGS

The foregoing and other features of the present disclosure will become more fully apparent from the following description and appended claims, taken in conjunction with the accompanying drawings. Understanding that these drawings depict several examples in accordance with the disclosure and are, therefore, not to be considered limiting of its scope, the disclosure will be described with additional specificity and detail through use of the accompanying drawings.

DETAILED DESCRIPTION

Generally, embodiments disclosed herein relate to systems, apparatuses and methods for separating a first material from a second material, for example, for separating solids from fluids. In particular, embodiments disclosed herein relate to apparatuses and methods for adjusting a weir to control the rate and/or speed at which drilling fluid feeds a separator. Multiple separators are typically used in parallel to process fluid returning from the well. A distribution manifold directs fluid to each separator. Further, systems, apparatuses and methods disclosed herein may have the weir positioned within a feeder on an inlet end of the separator and may connect to an attachment plate within the feeder. The distribution manifold or other flow control mechanism may operate in combination with the weir. Moreover, systems, apparatuses and methods disclosed herein may have adjustment apparatuses to control the height of the weir to determine the rate the fluid flows onto the separator. Furthermore, systems, apparatuses and methods disclosed herein may have various profiles of the weir to increase and/or decrease the speed of the fluid as the fluid spills into the separator.

Figure 1:
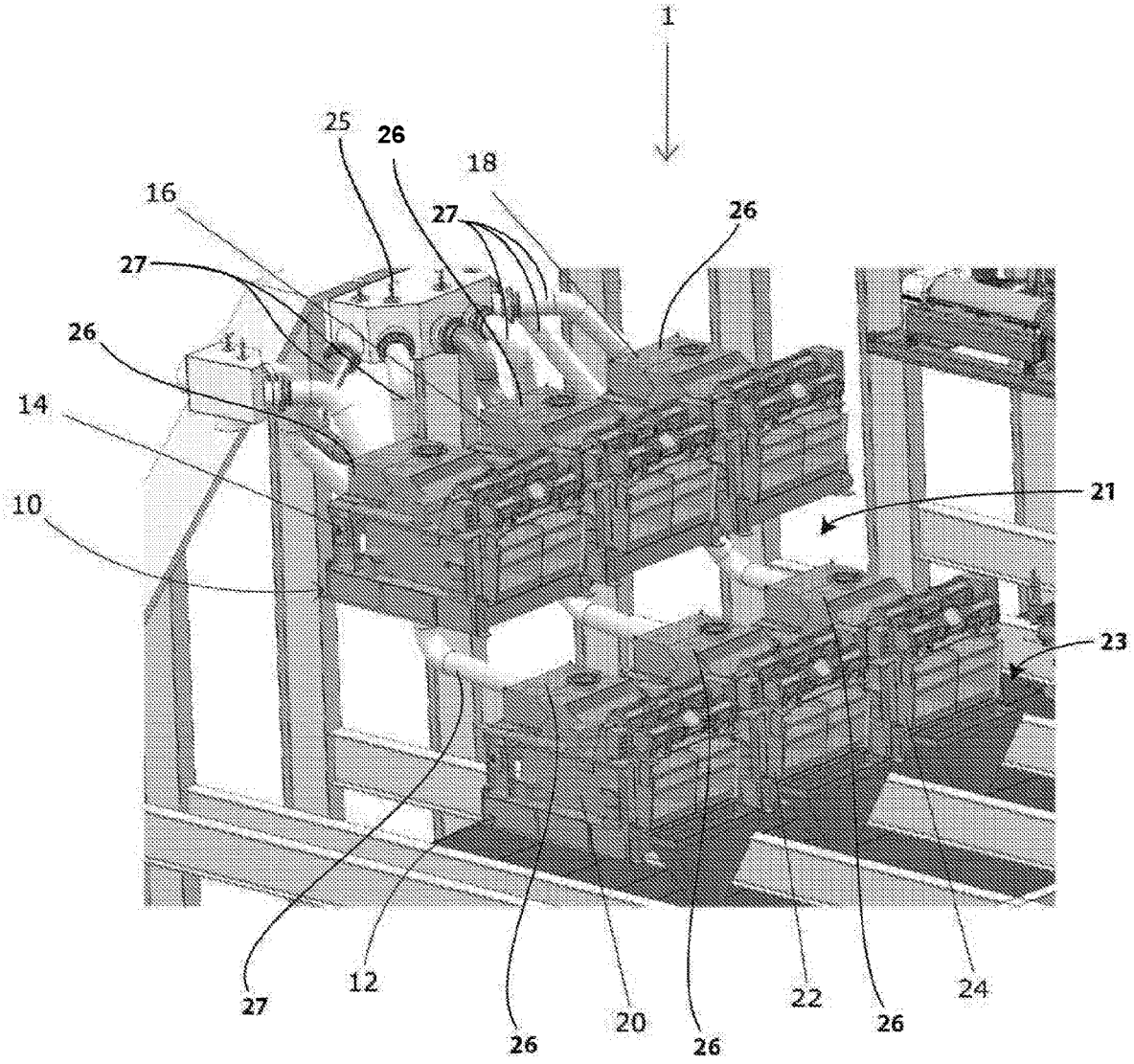
FIG. 1 is a perspective view of a separator system in accordance with embodiments of the present disclosure.

Referring to FIG. 1, a perspective view of a plurality of stacked separators forming a separator system 1 is shown. The stacked separators have at least a first line 10 and a second line 12. In an embodiment, the first line 10 may be three parallel separators 14, 16, 18 that may be arranged and/or connected with respect to three series separators 20, 22, 24. The parallel separators 14, 16, 18 may be configured for use in conjunction with the series separators 20, 22, 24, respectively. Although the parallel separators 14, 16, 18 and the series separators 20, 22, 24 are shown and described with reference to FIG. 1, it should be understood that the number of separators may be varied and/or configured as desired for a particular separator system 1 and/or application. The separator system 1 may be customized as desired.

The separator system 1 may have a distribution manifold 25 that may be configured to direct and/or control the flow of the slurry through the separator system 1. The distribution manifold 25 may connect to feeders 26 using multiple pipes 27 with corresponding valves, flow controllers, monitors and/or the like to control and/or regulate the flow of the slurry in the separator system 1. The feeder 26 may be a box on top at an inlet end 21 of the separator 24, for example. The feeder 26 is used to process drilling fluid returning from the well along with rock cuttings.

The separator system 1 may be configured to receive and process multiple slurries simultaneously. The separator system 1 may monitor the levels and/or loads of the slurry in the separators to assist in determining the overall efficiency of the separator system 1. Adjustments and/or changes to the separator system 1 may maximize performance of the separator system 1.

The separator system 1 may also be configured to bypass certain separators. Thus, the separator system 1 may provide the flexibility to switch between different configurations for the flow of the slurry. Certain separators of different types may be used or bypassed as desired to attain the separation of fluids and solids desired in various applications.

Figure 2:
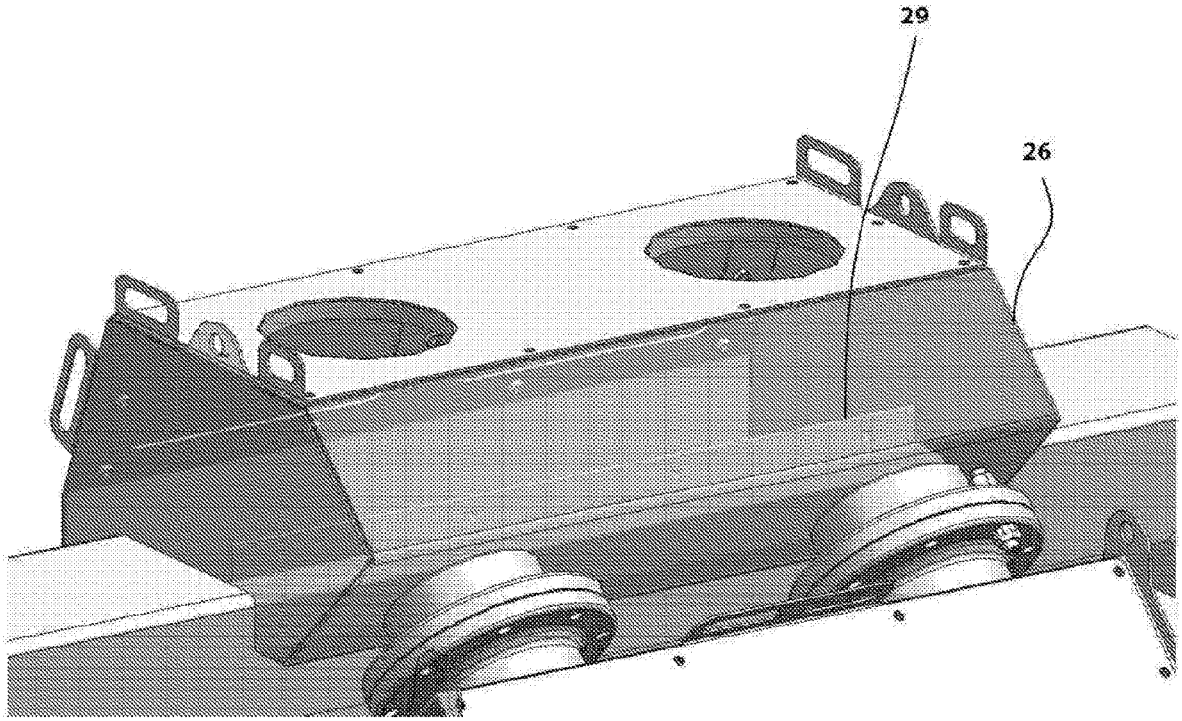
FIG. 2 is a perspective view of a feeder (including transparent portions for clarity) in accordance with embodiments of the present disclosure.

In addition to controlling the flow to the separator system 1 as previously described, the feeder 26 on each separator 14, 16, 18, 20, 22, 24 may supply the drilling fluid to the individual separators. For example, FIG. 2 illustrates the feeder 26 with an attachment plate 29. As illustrated in FIGS. 3-8, a weir 28 may connect to the attachment plate 29 located within the feeder 26. The weir 28 may be used for multiple purposes, such as, for example, controlling the rate and/or speed at which the drilling fluid feeds the separator. The weir 28 may also control the volume of fluid that flows onto the separator.

Specifically, the height and/or profile angle of the weir 28 in the feeder 26 may determine how quickly the fluid flows onto the separator. The weir 28 may operate in combination with the distribution manifold 25 as shown in FIG. 1 or other flow control mechanism. Various profiles of the weir 28 and adjustments of the height of the weir 28 within the feeder 26 may increase and/or may decrease the speed of the fluid as the fluid spills into the separator.

Figure 3:
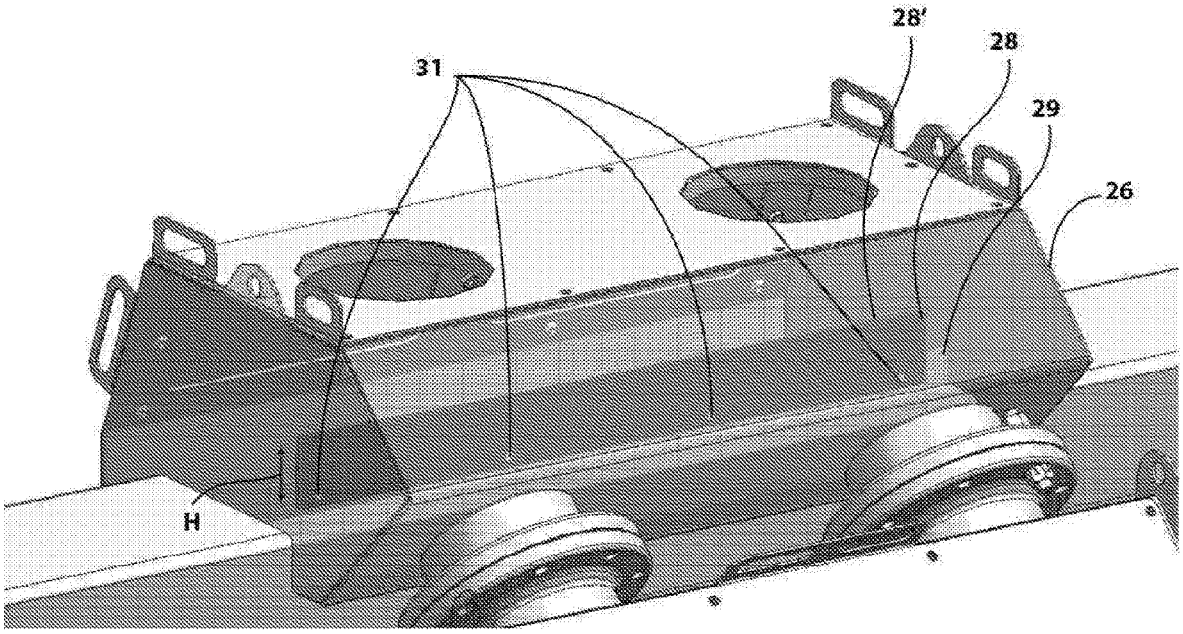
FIG. 3 is a perspective view of a feeder with a weir (including transparent portions for clarity) in accordance with embodiments of the present disclosure.
Figure 4:
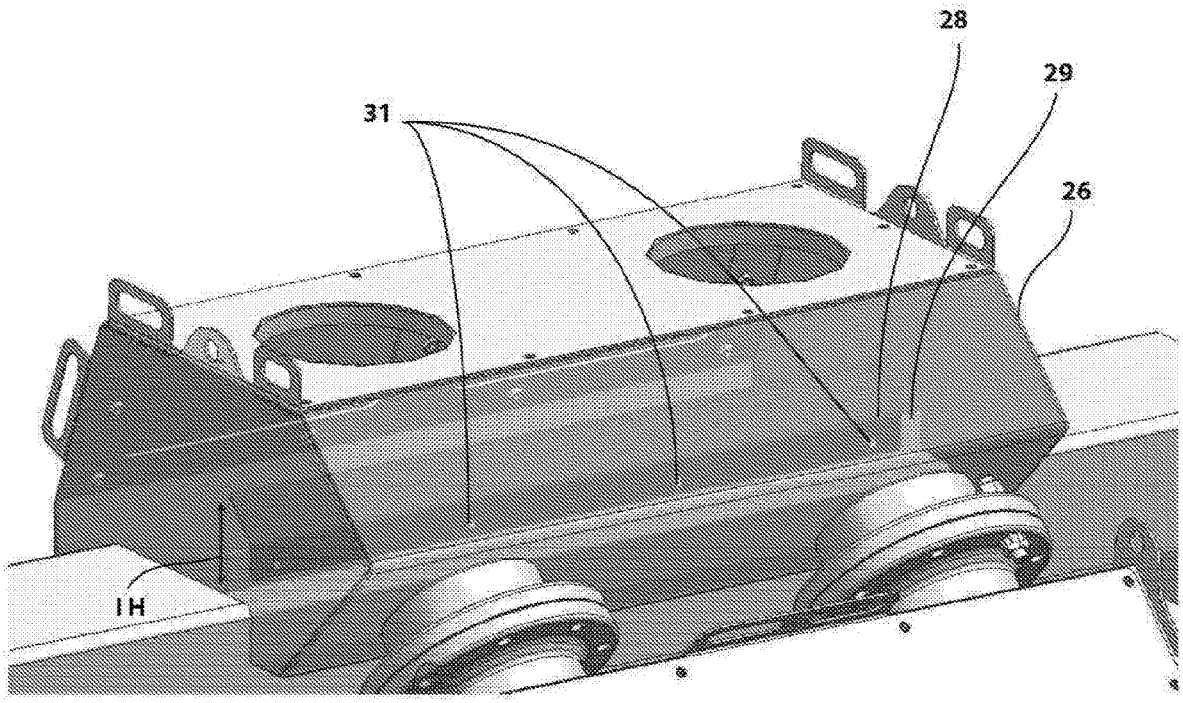
FIG. 4 is a perspective view of a feeder with another weir (including transparent portions for clarity) in accordance with embodiments of the present disclosure.
Figure 5:
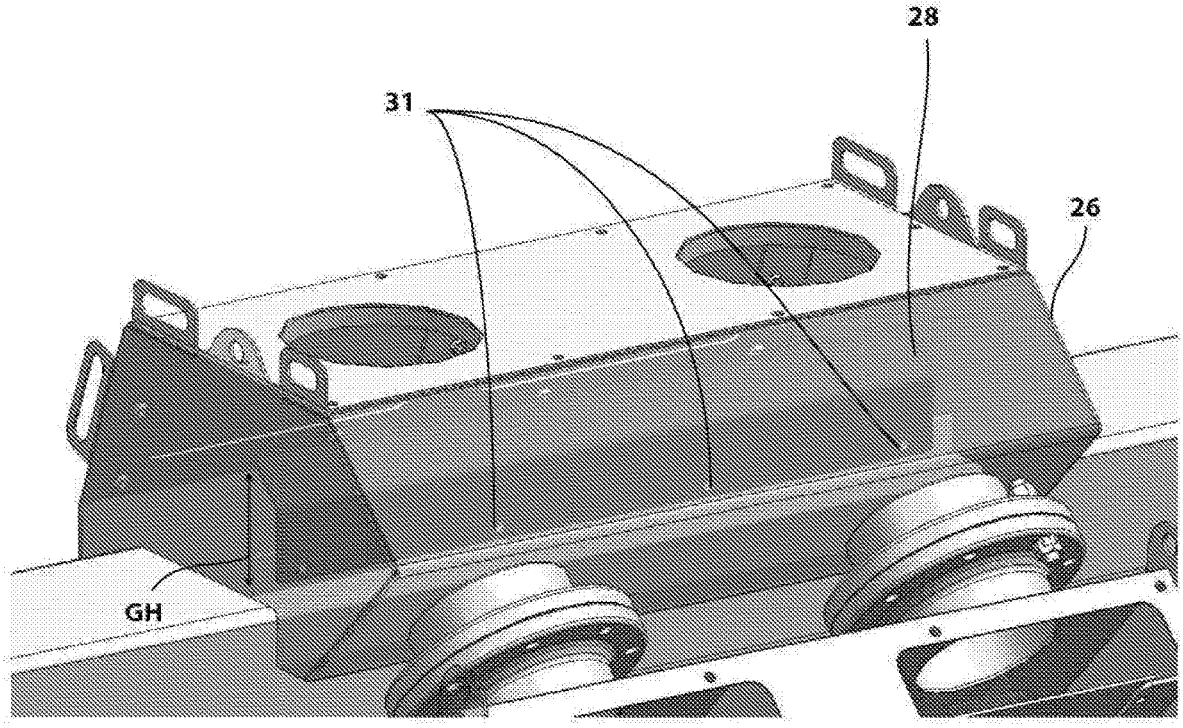
FIG. 5 is a perspective view of a feeder with yet another weir (including transparent portions for clarity) in accordance with embodiments of the present disclosure.
Figure 6:
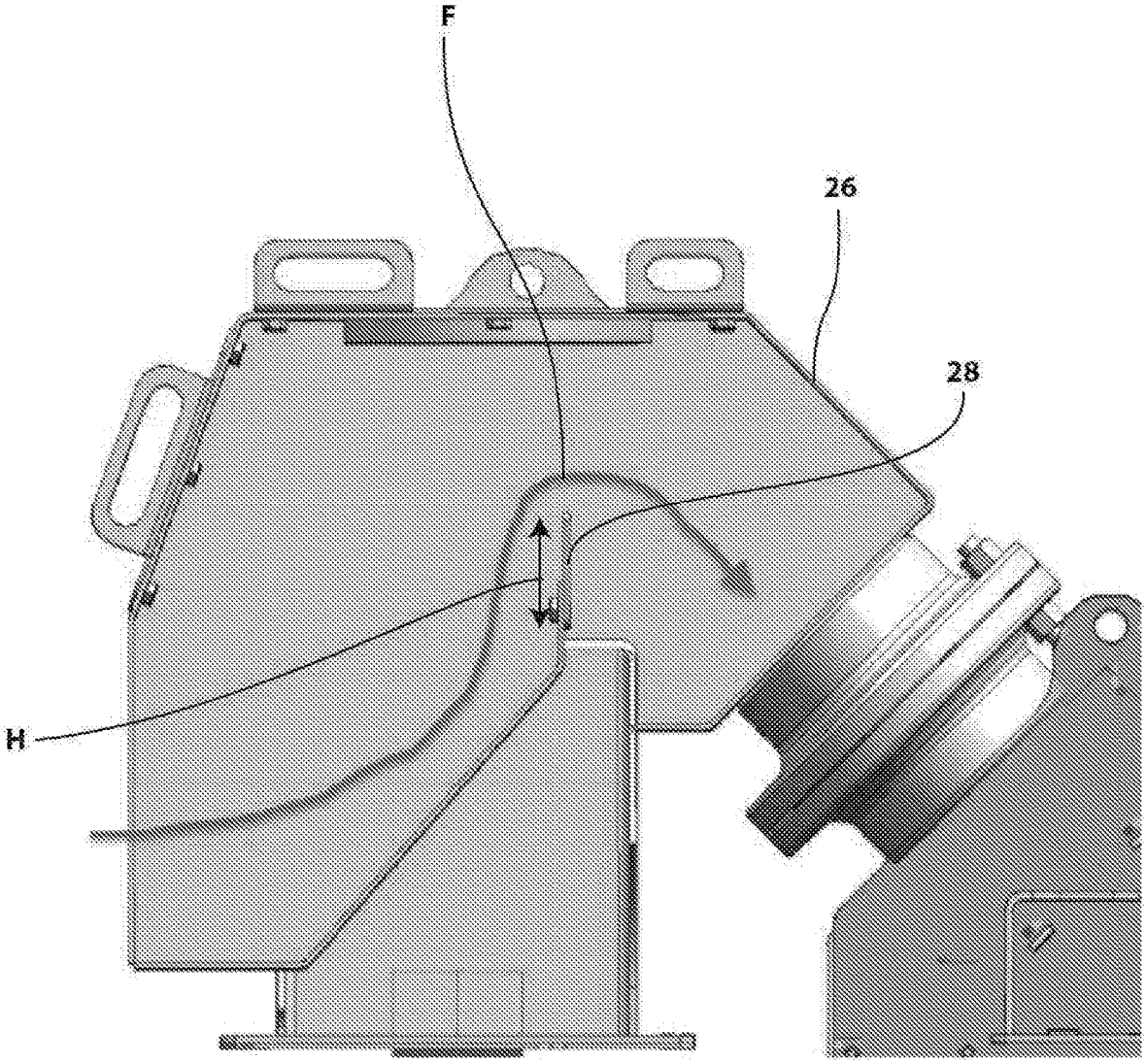
FIG. 6 is a cross-section view of a weir in accordance with embodiments of the present disclosure.
Figure 7:
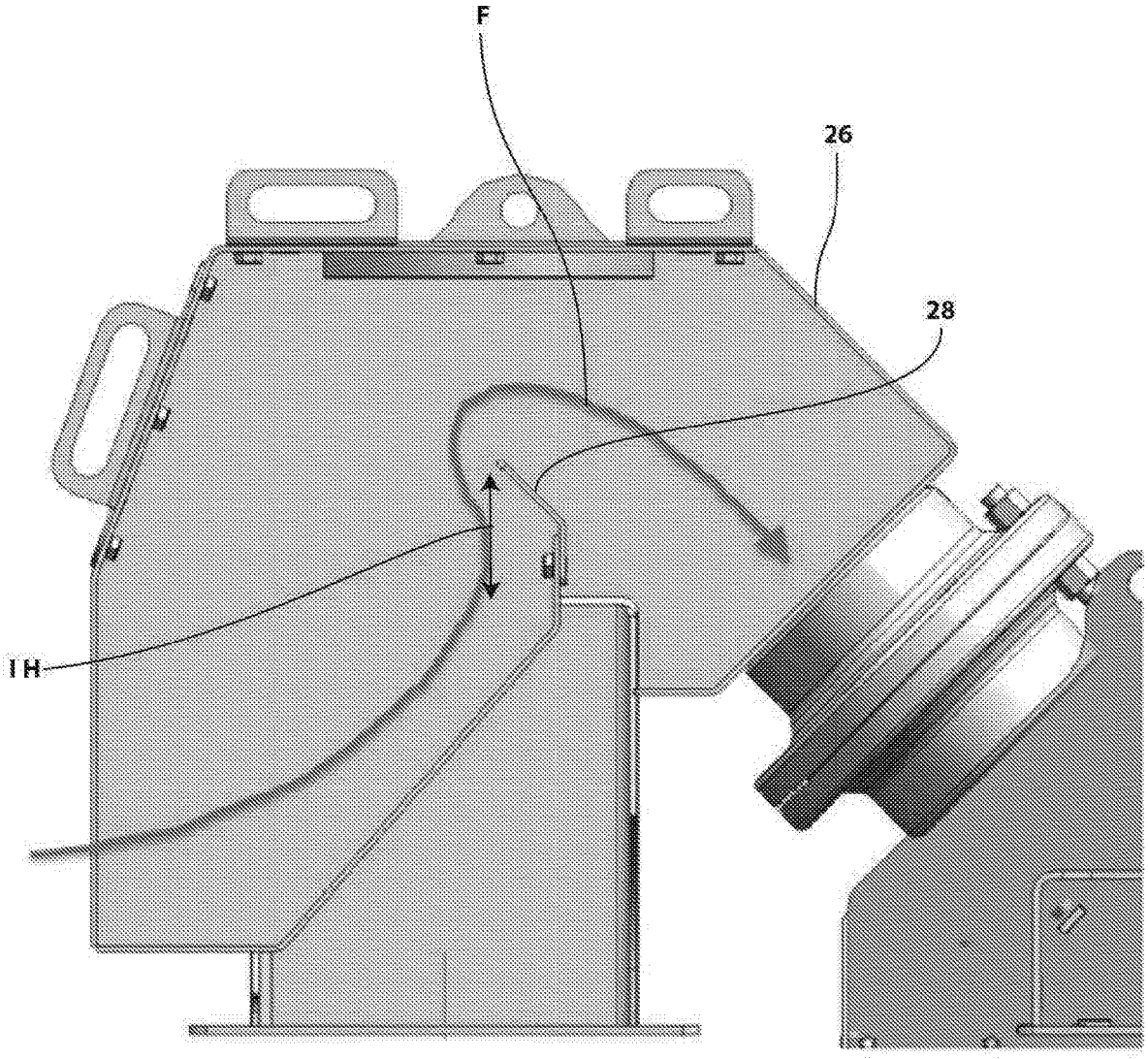
FIG. 7 is a cross-section view of another weir in accordance with embodiments of the present disclosure.
Figure 8:
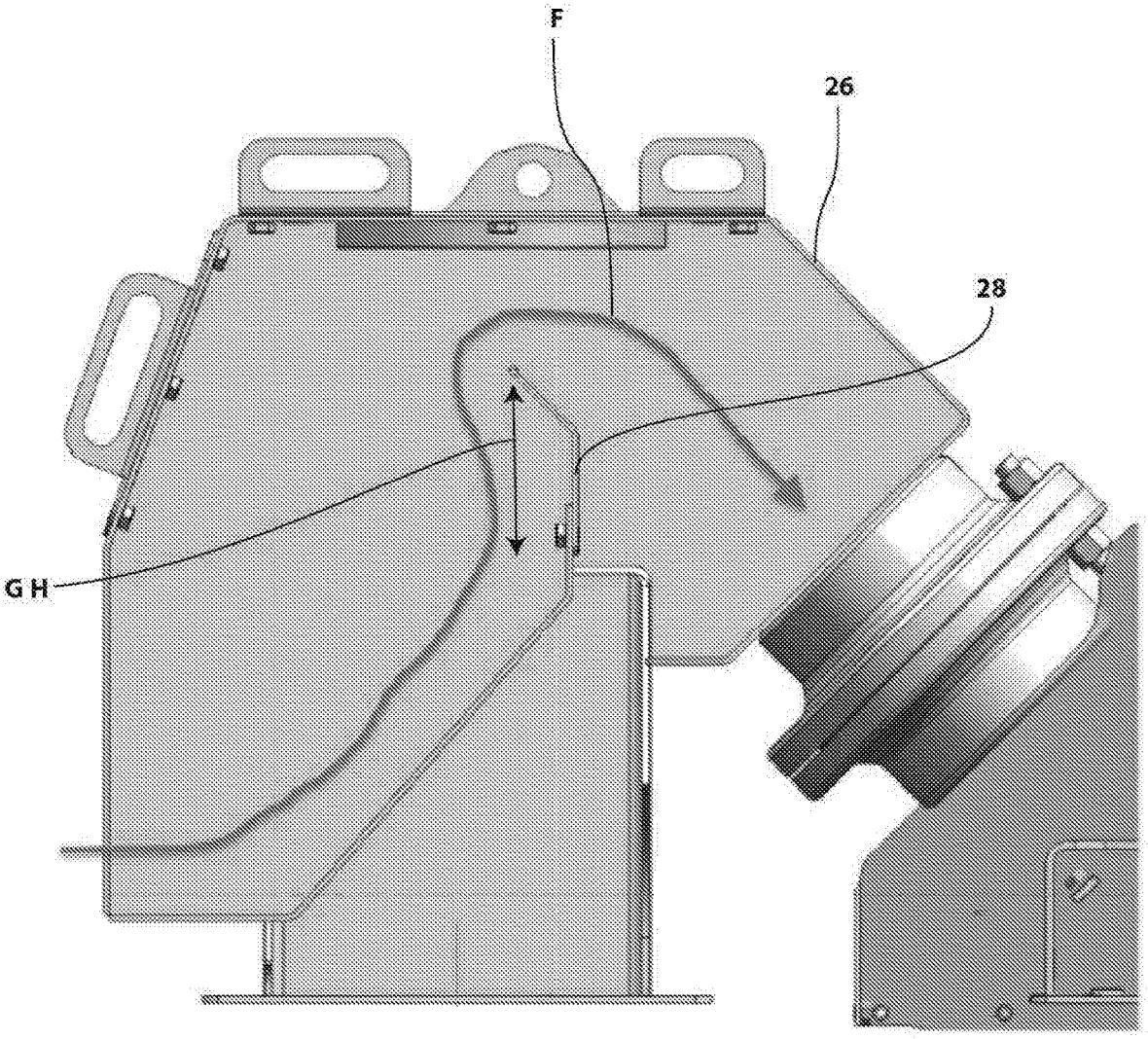
FIG. 8 is a cross-section view of yet another a weir in accordance with embodiments of the present disclosure.

FIGS. 3-8 illustrate three different embodiments of the weir 28 to control fluid flow through the feeder 26. FIGS. 3 and 6 illustrate two views of a first embodiment of the weir 28. FIGS. 4 and 7 illustrate two views of a second embodiment of the weir 28. FIGS. 5 and 8 illustrate two views of a third embodiment of the weir 28. Various attachment mechanisms and/or control mechanisms, such as, for example, automated, remotely controlled, hydraulically actuated, pneumatically actuated and/or the like, may be used to adjust and/or change the height and/or the profile of the weir 28 within the feeder 26.

As shown in the first embodiment in FIGS. 3 and 6, the weir 28 may have a flat plate 28' that may be secured by bolts 31, for example, to the attachment plate 29. However, various mechanisms, such as, automated, remotely controlled, hydraulically actuated, pneumatically actuated and/or the like, may be used to secure the flat plate 28' and/or the weir 28 within the feeder 26. Those skilled in the art, having benefit of this disclosure, will appreciate that other attachment mechanisms and/or control mechanisms may be devised which do not depart from the scope of the disclosure as described herein. Accordingly, the scope of the present disclosure should be limited only by the claims.

The weir 28 may cause a change in the momentum of the fluid and thus control the flow of the fluid as the fluid enters the separator. The weir 28 may cause a change in the velocity and/or volume of the fluid that may enter the separator. The weir 28 may cause a directional change in the flow of the fluid. A flow line as generally designated by the curved line F in FIG. 6 represents a path of the fluid passing through the feeder 26 in the first embodiment of the weir 28. The flow of the fluid entering the feeder 26 may reverse direction and/or change direction upon encountering the weir 28.

FIGS. 3 and 6 illustrate the weir 28 with a height H. The first embodiment of the weir 28 may slow the fluid to a lesser degree than the other embodiments shown. This configuration of the weir 28 may allow a greater amount of flow of the fluid through the feeder 26 than the other embodiments shown.

FIGS. 4 and 7 illustrate the weir 28 with an intermediate height IH and with a profile having an amount of rearward deflection. "Profile" as used herein refers to the configuration of the weir 28 when observed in a side view as shown in FIGS. 6-8. The profile may refer to an angle of deflection of the weir 28 relative to vertical. Also, "rearward" as used herein refers to a direction of the profile and/or angle of the weir 28 when observed in the side view as shown in FIGS. 6-8. Rearward deflection means the weir 28 angles to the left of vertical toward the inlet end 21 of the feeder 26.

The weir 28 may be secured to the attachment plate 29 with bolts 31, for example. However, various attachment mechanisms and/or control mechanisms, such as, automated, remotely controlled, hydraulically actuated, pneumatically actuated and/or the like, may be used to secure and/or adjust the weir 28 within the feeder 26.

The second embodiment of the weir 28 may slow the fluid more than the embodiment of the weir 28 shown in FIGS. 3 and 6. As shown in FIGS. 4 and 7, the profile of the weir 28 in the rearward direction may slow the drilling fluid so that the drilling fluid impacts an inlet screen (not shown) on the separator with less speed. The weir 28 may control the amount of fluid fed to the separator.

The flow line as generally designated by the curved line F in FIG. 7 represents a path of the fluid passing through the feeder 26 in the second embodiment of the weir 28. The flow of the fluid entering the feeder 26 may reverse direction and/or change direction upon encountering the weir 28.

FIGS. 5 and 8 illustrate the weir 28 with a greater height GH and a profile with the greater amount of rearward deflection than the other embodiments shown. The weir 28 may be secured to the attachment plate 29 with bolts 31, for example. However, various attachment mechanisms and/or control mechanisms, such as, automated, remotely controlled, hydraulically actuated, pneumatically actuated and/or the like, may be used to adjust the weir 28 within the feeder 26.

The third embodiment of the weir 28 may slow the fluid to a greater degree than the embodiments shown in FIGS. 3-4 and 6-7. The configuration of the weir 28 may allow less flow of the fluid through the feeder 26 than the other embodiments. The flow line as generally designated by the curved line F in FIG. 8 represents a path of the fluid passing through the feeder 26 in the third embodiment of the weir 28. The flow of the fluid entering the feeder 26 may reverse direction and/or change direction upon encountering the weir 28.

The embodiments shown in FIGS. 3-8 illustrate the weir 28 as plates that may be added or removed from the attachment plate 29 in the feeder 26 to control the flow of the drilling fluid through the separator. However, various attachment mechanisms and/or control mechanisms, such as, automated, remotely controlled, hydraulically actuated, pneumatically actuated and/or the like, may be used to secure and/or adjust the height and/or the angle of the weir 28 within the feeder 26.

Generally, the height of the weir 28 may be inversely proportional to the flow of fluid through the feeder 26 to the separator. Also, the amount of the profile of the weir 28 may inhibit the flow through the feeder 26.

During operation of the separator, the drilling fluid may be deposited into the feeder 26 to supply the separator. The drilling fluid may have a liquid-solid mixture that forms a "pool" on the separator. As the liquid-solid mixture moves across the separator deck (not shown), fluid may flow through the screens (not shown) so that solid matter may be discarded at a discharge end 23. "Beach" as used herein refers to a region where the pool of the liquid-solid mixture transitions to a region of primarily solid matter that is larger in size than apertures in the screens. Thus, "beach location" is the location at which the pooling of fluid terminates, and the slurry of drilling fluid and solids that are larger in size than apertures in the screens begin to separate. Only such solids convey further from that location toward the discharge end 23 of the separator.

Moreover, the drilling fluid on the separator may cover the screens except for a portion of the screen closest to the discharge end 23 of the separator. This portion of the discharge screen may permit time for the drilling fluid to separate from rock cuttings prior to the rock cuttings being discharged at the discharge end 23 of the separator. The location condition may generally optimize the life of the screens (not shown). For example, the screen may wear faster due to dry cuttings impacting the screen (not shown). Further, the location condition may affect fluid processing capacity.

Adjusting the height of the weir 28 in the feeder 26 may provide an operator with greater control over the drilling fluid as the drilling fluid enters the separator. Adjustment of the weir 28 may control the beach location on the separator screens to provide drier cuttings. To improve and/or to control the operation of the separator, the adjustment of the weir 28 may be related to operational conditions of the separator in the separator system 1.

For example, adjustment of the weir 28 may correspond to the beach location. The beach location may be monitored as disclosed in a commonly owned patent application, U.S. patent application Ser. No. 14/317,903 filed Jun. 27, 2014, entitled "Beach Detection Sensors for Vibratory Separator," the disclosure of which is incorporated herein in its entirety. The weir 28 may be adjusted to control the beach location for optimal performance of the separator system 1. Further, the weir 28 may be adjusted based upon a location of the beach.

The adjustment of the weir 28 may also be related to a flowrate measurement of the manifold 25 as shown in FIG. 1. For example, each separator may require more fluid in view of the amount of fluid returning. The weir 28 may require adjustment to increase the fluid amount and/or rate.

Also, the weir 28 may be adjusted based on a measurement related to drilling and/or operation of the separator, such as, for example, the rate of penetration of the drill bit, the drilling fluid pump rate, a measure of acceleration or motion profile of the separator and/or the like. For example, the weir 28 may be adjusted in relation to the drilling fluid pump rate. The weir 28 may be adjusted to reduce the flow to control a situation in which too much weight may impinge upon the separator screens. The excess fluid may negatively impact acceleration of the fluid on the separator.

Further, the weir 28 may be adjusted to different heights. For example, the weir 28 may be adjusted by bolting on different height plates and/or different shape plates to the attachment plate 29.

Figure 9:
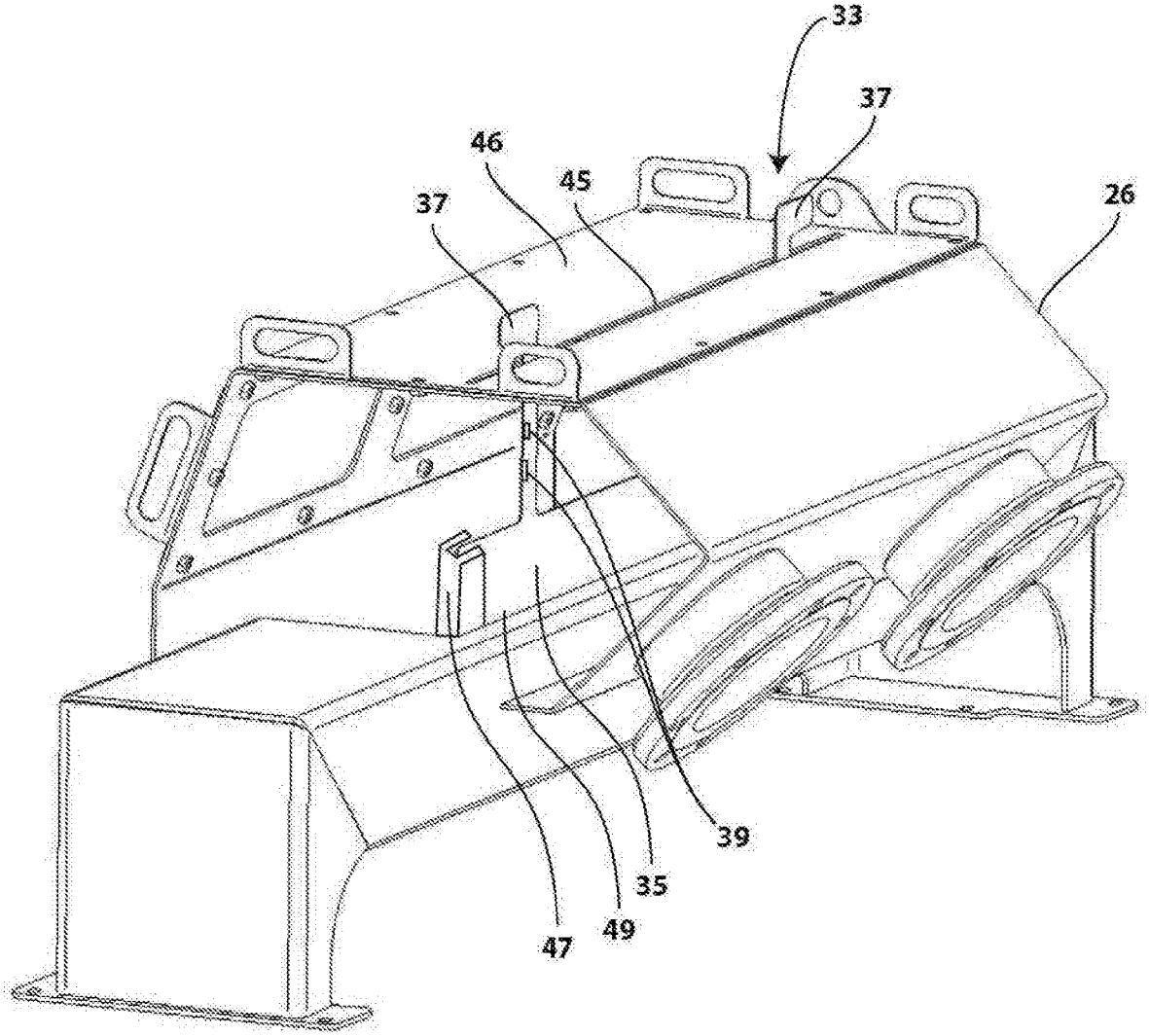
FIG. 9 is a perspective view of an adjustable weir in accordance with embodiments of the present disclosure.
Figure 10:
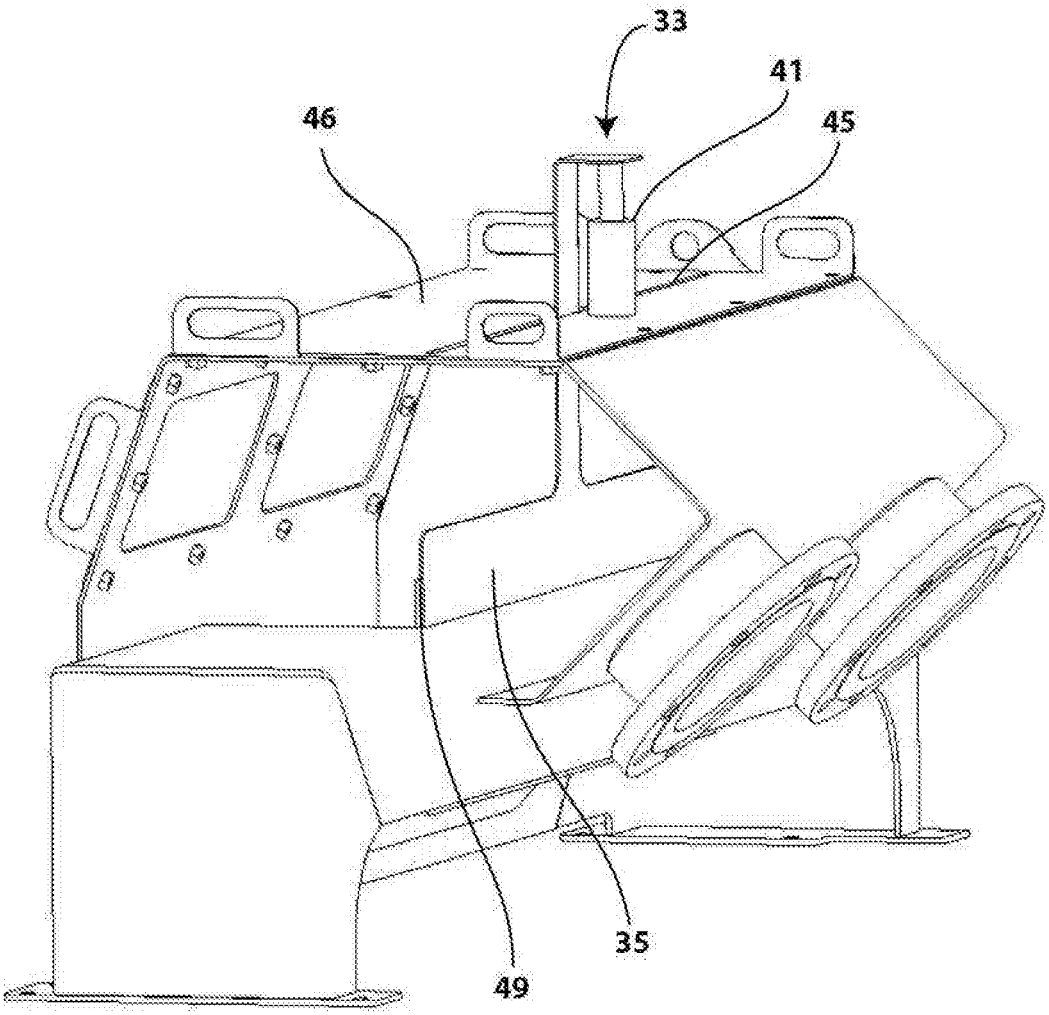
FIG. 10 is a perspective view of the feeder in accordance with embodiments of the present disclosure.
Figure 11:
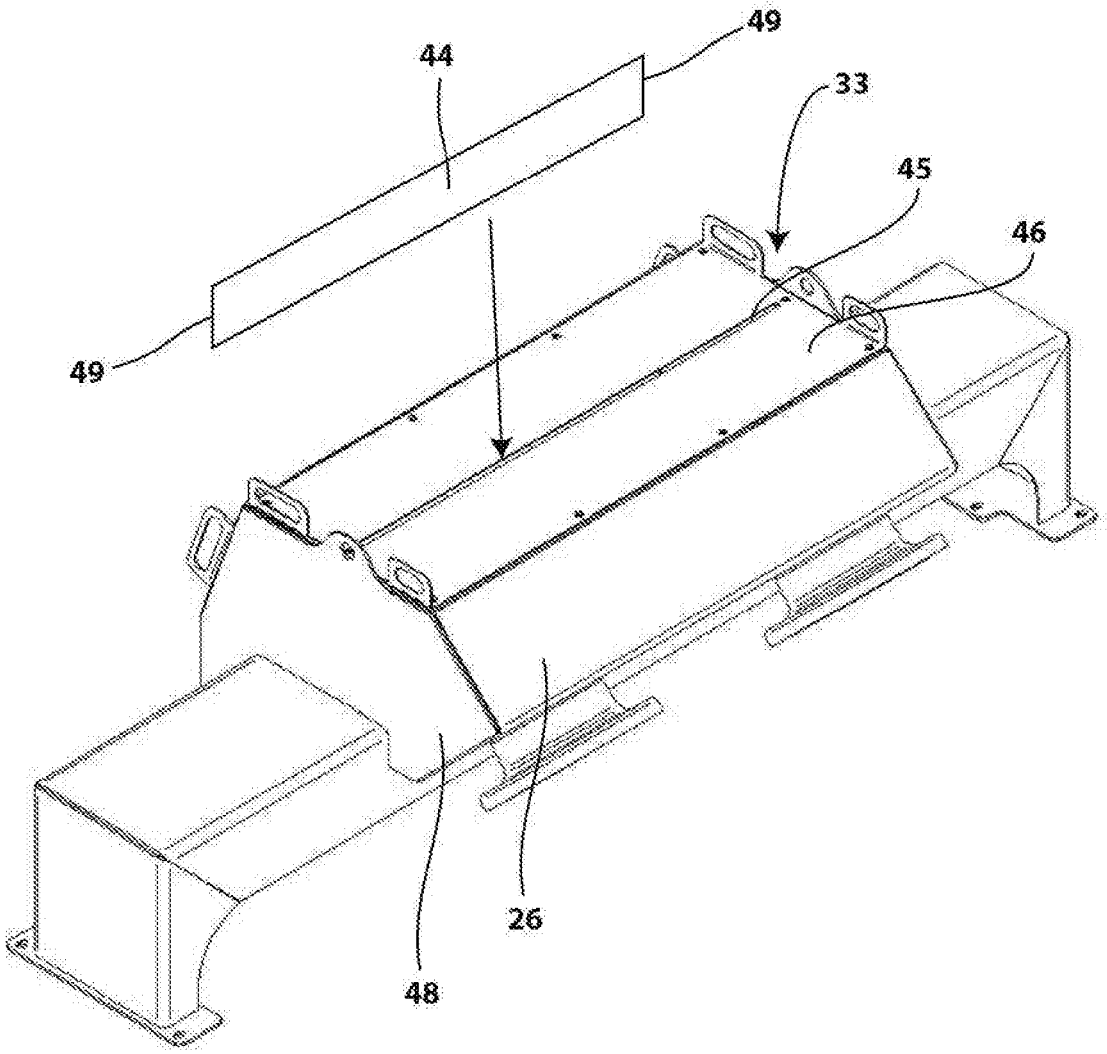
FIG. 11 is a perspective view of an adjustable weir in accordance with embodiments of the present disclosure.

In other embodiments shown in FIGS. 9-11, an adjustment apparatus 33 may control the weir 28. The adjustment apparatus 33 may have mechanical adjustment and/or automated adjustment that may respond to changes in the flowrate to the feeder 26 and/or may respond to a level of fluid on the screens in the separator.

For example, in the embodiment shown in FIG. 9, the weir 28 may have a slide gate 35 that may pass through a slot 45 in a lid 46 of the feeder 26. Channeled uprights 47 may be positioned at ends 49 of the slide gate 35. The channeled uprights 47 may receive the ends 49 of the slide gate 35 to hold the slide gate 35 in place and/or to provide rigidity to the slide gate 35. An operator may move the slide gate 35 within channeled uprights 47.

Further, the slide gate 35 may have handles 37 with which the operator may move the slide gate 35 within the channeled uprights 47. The slide gate 35 may lock in different positions. For example, notches 39 may be formed at regular intervals in the handles 37. The notches 39 may engage with the lid 46 to hold the slide gate 35 at a certain height within the feeder 26. The notches 39 may be aligned at the same heights in the handles 37 to maintain the slide gate 35 in a level position at a selected height.

FIG. 10 illustrates that the slide gate 35 connected to an actuator 41 that may have pneumatic operation and/or hydraulic operation to raise and/or lower the slide gate 35 to predetermined locations. The actuator 41 may be mounted to the lid 46 as shown in FIG. 10 or may be mounted to a side 48 of the feeder 26. The channeled uprights 47 (not shown in FIG. 10) may receive the ends 49 of the slide gate 35 to hold the slide gate 35 and/or to provide rigidity to the slide gate 35. The position of the slide gate 35 may be automated and/or remotely controlled to adjust the slide gate 35 in response to various separator operations and/or conditions.

Further, FIG. 11 illustrates an embodiment wherein the weir 28 may be adjusted by using drop-in plates 44 that may be added through the slot 45 in the lid 46 of the feeder 26. The operator may install the drop-in plate 44 into the channeled uprights 47 as shown in FIG. 11. The operator may use an operational measurement and/or an observation of the separator system 1 to determine the adjustments to the weir 28 required. Different size drop-in plates 44 and/or different shape drop-in plates 44 may improve and/or may increase performance of the separator system 1. The drop-in plates 44 may change the height of the weir 28 and/or the profile or angle of the weir 28. Insertion of the drop-in plates 44 may be manually performed and/or automated.

Embodiments disclosed herein relate to a system, apparatus and method for adjusting the weir 28 to control the rate and/or speed at which drilling fluid feeds a separator. Multiple separators are typically used in parallel to process fluid returning from the well. A distribution manifold 25 may direct fluid to each separator. The weir 28 may be positioned within the feeder 26 on the inlet end 21 of the separator. The weir 28 may connect to an attachment plate 29 within the feeder 26. The weir 28 may operate in combination with the distribution manifold 25 or other flow control mechanism. Various profiles of the weir 28 and adjustments of the height of the weir 28 within the feeder 26 may increase and/or decrease the speed of the fluid as the fluid spills into the separator.

Adjustment apparatuses 33 may control the height of the weir 28 to determine the rate the fluid flows onto the separator. The adjustment apparatuses 33 may be manual and/or automated to control the weir 28.

The height and/or the angle of the weir 28 may be adjusted based on a location of the beach, properties of the drilling fluid, such as, for example, the size of the solids, the type of drilling fluid, the composition of the solids and/or the like.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the present disclosure should be limited only by the attached claims.

What is claimed is:

1. An apparatus for controlling a flow of fluid to a shaker, comprising:

a feeder having an inlet and an outlet, the outlet being operatively coupled to a shaker, the feeder receiving fluid at the inlet and expelling the fluid at the outlet, and the feeder further comprising a lid defining a slot, and a first upright and a second upright, the first and second uprights each being disposed within an interior of the feeder and defining a channel;

a weir disposed within the respective channels of the first and second uprights within the feeder between the inlet and the outlet such that at least a portion of the fluid flows over a top portion of the weir to the outlet, the weir affecting the flow of fluid from the inlet to the outlet; and an adjustment apparatus extending from the weir and through the slot, wherein the adjustment apparatus comprises at least one drop-in plate configured to be inserted through the slot and into the respective channels of the first and second uprights, wherein the at least one drop-in plate provides an effective change in height of the weir.

2. The apparatus of claim 1, wherein the weir comprises a flat plate oriented in a substantially vertical orientation within the feeder.

3. The apparatus of claim 1, wherein the weir is removably coupled to the feeder.

4. The apparatus of claim 1, wherein the weir may be removed from the feeder and replaced by a replacement weir.

5. The apparatus of claim 1, wherein a height of the weir inside the feeder may be adjusted via the adjustment apparatus operable from outside of the feeder.

6. The apparatus of claim 5, wherein a relatively higher height of the weir allows less flow of fluid from the inlet to the outlet; and wherein a relatively lower height of the weir allows more flow of fluid from the inlet to the outlet.

7. The apparatus of claim 1, wherein the weir affecting the flow of fluid from the inlet to the outlet comprises at least one of:

decreasing a volume of fluid exiting the outlet;

decreasing a velocity of the fluid exiting the outlet;

decreasing a rate of flow of the fluid exiting the outlet; and changing a direction of the flow within the feeder.

8. A method for controlling a flow of fluid to a shaker, the method comprising:

disposing a weir in respective channels defined by first and second uprights disposed within an interior of a feeder coupled to a shaker inlet, the weir coupled to the interior such that at least a portion of the fluid flows over a top portion of the weir to an outlet of the feeder, the weir restricting fluid flow within the feeder, and the feeder further comprising a lid defining a slot; and adjusting the weir, via an adjustment apparatus extending from the weir and through the slot, to generate a greater restriction of fluid flow within the feeder or a lesser restriction of fluid flow within the feeder, wherein the adjustment apparatus comprises at least one drop-in plate, and wherein adjusting the weir comprises inserting the at least one drop-in plate through the slot and into the respective channels of the first and second uprights, wherein the at least one drop-in plate provides an effective change in height of the weir.

9. The method of claim 8, wherein the adjustment apparatus is at least one of automated, remotely controlled, manually actuated, hydraulically actuated, and pneumatically actuated.

10. The method of claim 8, wherein the adjusting the weir is based on at least one of a rate of penetration of a drill bit in a drilling operation, a drilling fluid pump rate, a measure of acceleration of the shaker, and a motion profile of the shaker.

* * * * *